United States Patent [19]

Morel

[11] Patent Number: 4,858,777

[45] Date of Patent: Aug. 22, 1989

[54] CONTAINER WITH A REMOVABLE CAP HAVING SIDE GENERATING LINES IN ALIGNMENT WITH THOSE OF THE CONTAINER

[76] Inventor: Simone Morel, 15 rue du Faubourg de Paris, 51210 Montmirail, Marne, France

[21] Appl. No.: 240,829

[22] Filed: Sep. 6, 1988

[30] Foreign Application Priority Data

Sep. 15, 1987 [FR] France ..... 87 12761

[51] Int. Cl.[4] ..... B65D 41/06

[52] U.S. Cl. ..... 215/295; 215/331

[58] Field of Search ..... 215/295, 331, 329, 339, 215/340; 220/288, 304

[56] References Cited

U.S. PATENT DOCUMENTS

| | | | |
|---|---|---|---|
| 2,264,792 | 12/1941 | Gray et al. | 215/331 |
| 2,476,155 | 7/1949 | McKelvy | 215/295 |
| 3,826,397 | 7/1974 | Atkins | 215/295 |

FOREIGN PATENT DOCUMENTS

| | | | |
|---|---|---|---|
| 79/00584 | 8/1979 | World Int. Prop. O. | 215/295 |

*Primary Examiner*—Donald F. Norton

*Attorney, Agent, or Firm*—Wallenstein, Wagner & Hattis

[57] ABSTRACT

The container has a top part formed with at least one boss having a first side spaced apart from the outer surface of the container by a measure corresponding to the wall thickness of the cap and an other side which defines a ramp. An extreme edge of the boss is in turn spaced apart from the outer surface of the container by a measure which is equal to the wall thickness of the cap and defines a groove corresponding to a rib formed from the inner wall of the cap.

6 Claims, 1 Drawing Sheet

CONTAINER WITH A REMOVABLE CAP HAVING SIDE GENERATING LINES IN ALIGNMENT WITH THOSE OF THE CONTAINER

BACKGROUND OF THE INVENTION

The present invention relates to closing devices for various containers and, in particular, for containers used in perfumery, cosmetology, pharmacy as well as in other industries.

It is generally desired, from an aesthetic point of view, that the plug or cap and the container are in perfect alignment, meaning that they seem to form a single unit when they are assembled together despite the fact that obviously the cap, also from an aesthetic point of view, may be of a color different to that of the container.

Closing devices of this type are already known in the art. However, a setting in position of a plug or cap is tied to difficulties since a user does not know, prima facie, if he (or she) has to pull up the cap, or if he (or she) has to turn the cap with respect to the container, or still if he (or she) has to look for a kind of appendix used as a command means.

OBJECT OF THE INVENTION

An object of the invention is to provide a container with a removable cap the opening of which is extremely simple and the closing of which is also made easy even for a user paying little attention. Actually, the closing operation necessarily brings the cap and the container close to each other in a position in which only a convenient closing and latching operation can be made.

Likewise, a reopening of the container by a movement reverse to that causing the closing thereof brings about a spacing between the cap and the container, making obvious to the user that the handling so made is correct.

SUMMARY OF THE INVENTION

According to the invention, the container with a removable cap having an inner surface in alignment with an outer surface of the container, has a top part formed with at least one boss having a first side spaced apart from the outer surface of the container by a measure corresponding to a wall thickness of the cap and an other side which defines a ramp, an extreme edge of the boss being in turn spaced apart from the outer surface of the container by a measure which is equal to the wall thickness of the cap and defining a groove corresponding to a rib formed from an inner wall of the cap.

Various other features of the invention will become more apparent from the following detailed description.

BRIEF DESCRIPTION OF THE DRAWINGS

An embodiment of the invention is shown by way of non limiting example in the accompanying drawings, wherein.

BEST MODE FOR CARRYING OUT THE INVENTION

The drawings generally illustrate at 1 a container which can be indifferently a flask, a pot, a case or a box of any cross-sectional shape.

The container 1 is intended for being closed by a cap 2 having in cross-section, the same shape as that the container 1, so that the cap 2 and the container 1 will have aligned cap and container surfaces when the container 1 and cap 2 are assembled together.

Figure 1:
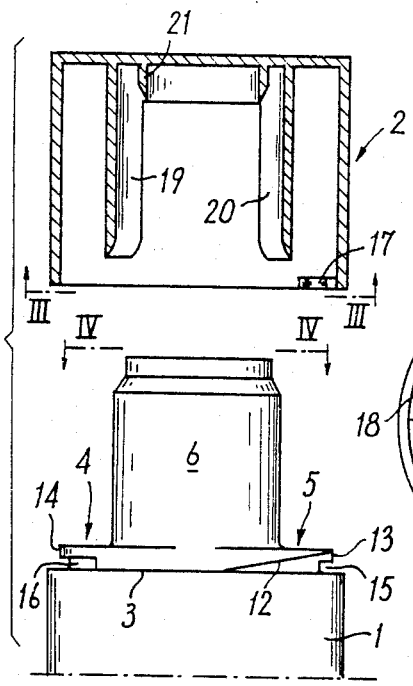
FIG. 1 is an exploded elevation view, partly in cross-section, of a container and of its cap embodying the invention.
Figure 2:
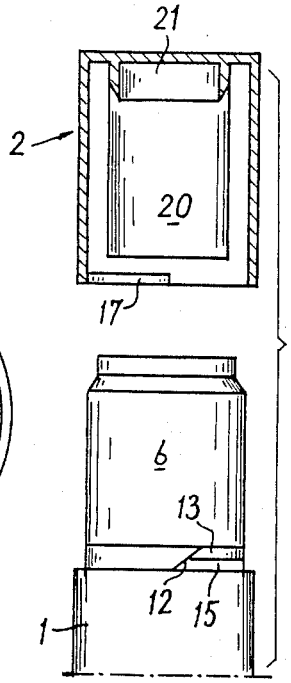
FIG. 2 is an exploded elevation view partly in cross section similar to FIG. 1, but turned over 90° with respect to FIG. 1.
Figure 3:
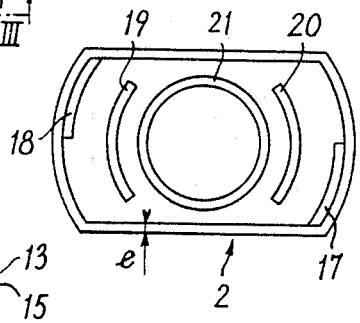
FIG. 3 is a plan view along line III—III of FIG. 1.
Figure 4:
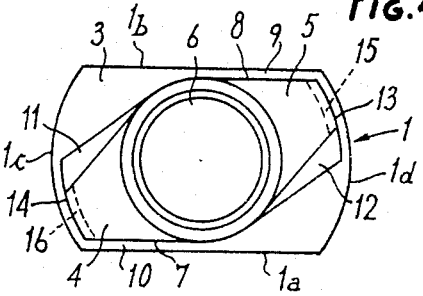
FIG. 4 is a plan view along line IV—IV of FIG. 1.

The container 1 has, in cross-section, the shape of a rectangle with rounded small sides and the same applies to the cap 2, which is shown in particular in FIGS. 3 and 4.

Figure 6:
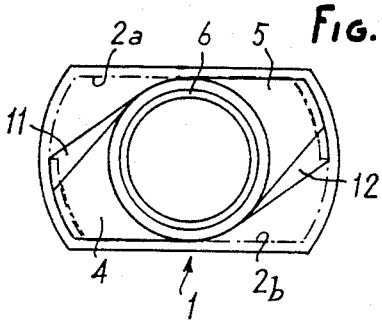
FIG. 6 is a plan view similar to FIG. 4 but showing the position of the cap when put in position on the container.
Figure 5:
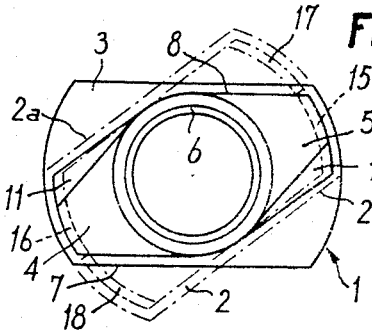
FIG. 5 is a plan view similar to FIG. 4 diagrammatically illustrating a particular position of the cap.

The container 1 includes a top part 3 which is plane and from which protrude two symmetrical bosses 4, 5 and a neck 6. As shown in FIGS. 4–6, the bosses 4, 5 define each, on one side, an abutment 7, respectively 8. The abutments 7 and 8 are separated from the sides 1*a*, 1*b* of the container 1 by a space 9, respectively 10, the width of which corresponds to the wall thickness e (FIG. 3) of the cap 2. Opposite the abutments 7, 8, the bosses 4, 5 define ramps 11, 12 which extend in a helical shape from the extreme edge 13, respectively 14, of each boss up to a generating line tangent to the neck 6. The extreme edges 13, 14 of the bosses 4, 5 are spaced apart from the smaller sides 1*c*, 1*d* of the container 1, and therefore from the outer surfaces of that container, by a measure which corresponds also to the wall thickness e of the cap 2. Grooves 15 and 16 are formed below the extreme edges 13, 14.

As is explained hereabove, the cap 2 has, in cross-section, the same shape as the container 1 and its wall thickness is uniform, as shown in the drawings particularly in FIG. 3, in order to facilitate a manufacture of the cap 2. One would not depart from the scope of the invention by having the larger and smaller sides of the cap 2 with different wall thicknesses, but it is essential according to the invention that the inner surface of the cap 2 are in alignment with the outer surfaces those of the container 1 when the cap 2 and the container 1 are assembled and when the container 1 is in the closed condition thereof.

As illustrated in the drawings, the cap 2 has two ribs 17, 18, the two ribs 17, 18 being provided at the base of the cap 2 which is opened and along a portion of its smaller sides.

The ribs 17, 18 have a thickness which corresponds to that of the grooves 15, 16.

In order to facilitate a centering of the cap 2 with respect to the container 1, it is advantageous as shown that the cap 2 has centering wings 19, 20 in a shape of circular sectors and spaced apart by a measure corresponding to the outer extreme diameter of the neck 10 which is of a circular shape when the cap 2 is provided with the wings 19, 20.

The cap 2 is also provided with a sealing member illustrated in the shape of an annular deformable lip 21 for cooperating with the upper portion of the neck 6. Obviously, another type of sealing member could also be used.

In order to position the cap 2 on the container 1, the wings 19, 20 of the cap 2 are placed to surround the neck 6 while offsetting the cap 2 by ⅛th of a turn with respect to the container 1 so that the free base of the cap 2 will bear on the top part 3 of the container 1.

The user can determine immediately the measure according to which the cap 2 has to be angularly offset with respect to the container 1. Actually, if the measure of the offset is too small or on the contrary too large, the ribs 17, 18 at the base of the cap 2 will come to bear on top of the bosses 4, 5 of the container 1 so that the base of the cap 2 cannot come to bear on the top part 3 of the container 1. The ramps 11, 12, on which the base of the cap 2 can slide, will facilitate a setting in position of the cap 2.

When the cap 2 is conveniently presented with respect to the container 1, which is illustrated in phantom lines in FIG. 5, the ribs 17, 18 are just opposite the opening of the grooves 15, 16 and the larger sides 2*a*, 2*b* of the cap 2 are at the base of the ramps 11, 12. By rotating the cap in the clockwise direction, the ribs 17, 18 are engaged into the grooves 15, 16 until the inner walls of the larger sides 2*a* 2*b* of the cap 2 will come up against the abutments 7, 8 of the container 1.

Since the wall thickness of the cap 2 corresponds to the width of the spaces 9, 10, the inner surfaces of the larger sides of the cap 2 are then necessarily in alignment with the outer surface of the container 1, and the same is obviously true as regards the inner surface of the smaller sides of the cap 2 with the outer surface of the smaller sides of the container 1, as illustrated in FIG. 6.

When, it is desired to remove the cap 2 from the container 1, the user has to rotate the cap 2 in the counterclockwise direction so that the cap 2 is brought back to the position illustrated in FIG. 5.

Upon a further rotation of the cap 2 in the counterclockwise direction, the larger sides 2*a*, 2*b* of the cap 2 will slide along the ramps 11, 12, effect of which is to start lifting the cap 2 with respect to the container 1.

The user can then freely disengage the cap 2.

The invention is not limited to the embodiment shown and described in detail since various modifications thereof can be carried out thereto without departing from its scope. Particularly, the ribs 17, 18, as well as the walls of the grooves 15, 16, can form mating ramps in order to provide for a wedging and consequently a latching of the cap 2 on the container 1 at end of the setting in position operation. Moreover, a single boss 4 or 5 can be provided, particularly when the neck 6 is misaligned with respect to the body of the container 1.

What is claimed is:

1. A container with a removable cap having aligned cap inner and container outer surfaces wherein the container has a to part formed with at least one boss having a first side spaced apart from said aligned surfaces of the container by a measure corresponding to a wall thickness of the cap and an other side which defines a ramp, an extreme edge of the boss being in turn spaced apart from side generating lines of the container by a measure which is equal to the wall thickness of the cap and defining a groove corresponding to a rib formed from an inner wall of the cap.

2. A container as set forth in claim 1, wherein the container defines two symmetrical bosses, and wherein the cap has two symmetrical ribs.

3. A container as set forth in claim 2, wherein the container is provided with a neck, and wherein the symmetrical bosses are formed on either side of said neck.

4. A container as set forth in claim 1, wherein the cap contains precentering wings.

5. A container as set forth in claim 4, wherein said container is provided with a neck, and wherein the precentering wings are provided for surrounding the neck of the container.

6. A container as set forth in claim 1, wherein cap is provided with a sealing member.

* * * * *

UNITED STATES PATENT AND TRADEMARK OFFICE

CERTIFICATE OF CORRECTION

PATENT NO. : 4,858,777

DATED : August 22, 1989

INVENTOR(S) : Simone Morel

It is certified that error appears in the above-identified patent and that said Letters Patent is hereby corrected as shown below:

Column 2, Line 47, delete "those"

Column 3, Line 39, after "12," insert --the--

Column 4, Line 36, delete "the" and insert --said--

Column 4, Line 38, after "wherein" insert --the--

Signed and Sealed this

Eleventh Day of September, 1990

*Attest:*

HARRY F. MANBECK, JR.

*Attesting Officer*

*Commissioner of Patents and Trademarks*